US005907896A

United States Patent [19]

Tseng

[11] Patent Number: 5,907,896

[45] Date of Patent: Jun. 1, 1999

[54] METHOD FOR BENDING FORGING ARTISTIC METALLIC PIPES

[76] Inventor: Shao-Chien Tseng, No. 130, Sec. 2 Yung-Shin Rd., Yang-Mei, Taoyuan 326, Taiwan

[21] Appl. No.: 08/926,740

[22] Filed: Sep. 10, 1997

[51] Int. Cl.[6] ..... B21D 35/00

[52] U.S. Cl. ..... 29/424; 29/469.5; 29/527.4; 72/369; 72/466.2; 264/221; 264/295; 264/339

[58] Field of Search ..... 29/423, 424, 890.14, 29/890.144, 421.1, 469.5, 527.2, 527.4, 530; 72/369, 466.2, 466.8, 466; 264/295, 339, 221, 317

[56] References Cited

U.S. PATENT DOCUMENTS

| | | | |
|---|---|---|---|
| 2,070,589 | 2/1937 | Giacchino | 29/423 |
| 2,389,038 | 11/1945 | German | 29/423 |
| 2,406,838 | 9/1946 | Kepler | 29/423 |
| 3,992,505 | 11/1976 | Tally | 264/295 |
| 4,186,586 | 2/1980 | Takamura et al. | 29/423 |
| 4,393,565 | 7/1983 | Wilson, II et al. | 29/423 |
| 4,440,712 | 4/1984 | Imgram | 264/295 |
| 4,493,203 | 1/1985 | Wheeler et al. | 72/369 |
| 4,533,512 | 8/1985 | Altman et al. | 264/339 |
| 4,740,336 | 4/1988 | Connen et al. | 264/295 |
| 4,743,481 | 5/1988 | Quinlan et al. | 264/221 |
| 4,841,760 | 6/1989 | Ferguson | 72/369 |
| 5,054,185 | 10/1991 | Usui et al. | 29/424 |
| 5,160,685 | 11/1992 | Moran, Jr. | 264/339 |
| 5,339,868 | 8/1994 | Naoi et al. | 72/369 |
| 5,369,973 | 12/1994 | Wendorff | 72/369 |
| 5,422,048 | 6/1995 | Kodama et al. | 264/295 |
| 5,491,883 | 2/1996 | Marlinga | 29/421.1 |
| 5,555,762 | 9/1996 | Kawamura et al. | 72/369 |
| 5,644,829 | 7/1997 | Mason et al. | 29/421.1 |
| 5,682,781 | 11/1997 | Schwarze | 72/369 |
| 5,693,284 | 12/1997 | Mukawa | 264/317 |
| 5,765,285 | 6/1998 | Buy et al. | 72/369 |
| 5,784,918 | 7/1998 | Shao-Chien | 29/423 |

FOREIGN PATENT DOCUMENTS

| | | | |
|---|---|---|---|
| 0115796 | 8/1984 | European Pat. Off. | 72/466 |
| 0117317 | 9/1984 | European Pat. Off. | 72/369 |
| 2321345 | 3/1977 | France | 72/466 |
| 51-25221 | 7/1976 | Japan | 29/423 |
| 58-78353 | 5/1983 | Japan | 29/424 |
| 62-192214 | 8/1987 | Japan | 72/466 |
| 1459761 | 2/1989 | U.S.S.R. | 72/369 |
| 315758 | 12/1930 | United Kingdom | 29/423 |

*Primary Examiner*—Irene Cuda
*Assistant Examiner*—Trinh Nguyen
*Attorney, Agent, or Firm*—Pro-Techtor International Services

[57] ABSTRACT

A method for bend forging an artistic metallic straight pipe, wherein, a die core made from a steel rope is placed in the pipe bore, and a filler with plastisol uniformly mixed up is then introduced into the pipe bore until it is saturated to form a solid straight pipe. The latter is placed in an upper and a lower bendable die housing each of which forms a trough, and both ends of the die housings are provided with latch holes. Polyurethane is poured into the troughs to envelop the straight pipe, many hard bracing stubs are buried in the top/bottom of the troughs after heating, to solidify the polyurethane, a flexible die set is formed. The external top and bottom surfaces of the upper and lower die housings are provided thereon with two laminated springs, so that when the die set is forged, action force can be uniformly distributed to render the straight pipe to be bending forged to have the desired bending curvature. The bent solid pipe is then taken out, the pipe bore is heated to slightly melt and take out the plastisol in the die core, and a hollow bent artistic metallic pipe is thus formed.

2 Claims, 7 Drawing Sheets

METHOD FOR BENDING FORGING ARTISTIC METALLIC PIPES

BACKGROUND OF THE INVENTION

1. Field of the Invention

The present invention is related to a method and for bending forging an artistic metallic pipes and especially to bending forging of a metallic pipe, wherein, a pressure resistive removable and bendable die core is provided in a pipe bore, and a flexible die set is provided for receiving the pipe body, in this way, when it is under action of a normal forging force, a straight metallic pipe having an artistic contour can be forged into a bended metallic pipe having an artistic contour and a smooth curvature.

2. Description of the Prior Art

In the well known metallic pipe processing techniques in the markets, a metallic article made by forging has much higher compression strength than that of the metallic articles made by casting or extruding techniques; therefore, when compressive strength of the metallic articles to be forged is critical, the metallic articles always are made by forging. In the manufacturing techniques used nowadays for making an artistic metallic pipe however, there have been swaging techniques to make a metallic embossed pipe with high compressive strength, the swaging techniques include using of a rotary swager, a stationary-spindle swager, a creeping-spindle swager, an alternate-blow swager or a die-closing swager etc., metallic pipes made by progressive swaging in such techniques have on both the inner and the external walls thereof embossed patterns, these pipes are generally called herein artistic metallic pipes; no matter the artistic metallic pipes formed have any of various embossment, such swaging techniques are all available only for processing normal metallic pipes. Artistic metallic pipes formed by swaging techniques are certainly all straight in shape; There is no such technique in the markets for making bended pipes with smooth curvature but without damage to the predetermined embossments on the inner and the external walls thereof, this has been a regret in the field of pipe forging, and the problems thereof are:

1. The pipe bores of the pipes to be forged into bended pipes can not be installed therein with and removed therefrom supporting die cores.
2. Die sets for forging bended pipes are absent, which die sets are required to be deformable following bending moment and to distribute uniform action force.

SUMMARY OF THE INVENTION

What the present invention provides is a design in relation to the above problems in forging into an artistic metallic bended pipe which problems are not yet solved in the art.

The object of the present invention is to provide a bendable die core filled with plastisol and having a swaging pressure resistive supporting wall, and to provide a flexible die set which can distribute uniform forging action force for forging a bended pipe; the artistic metallic straight pipe is bending forged into a bended pipe having the desired curvature by using of the die core and the die set.

To achieve the above stated objects, the followings are the technical characteristics of the present invention:

1. The die core in a pipe bore is made from a steel rope, the wall of the pipe bore has an artistic pattern thereon, according to strength requirement and thickness of the metallic pipe wall, suitable amount of small steel balls or iron sand are added into plastisol and stirred under the melting temperature (80–100° C.) thereof in a conventional pounding mixer to form thoroughly a mixed filler; the filler is introduced into the pipe bore by a well known screw feeding mode to a saturated state, temperature during introducing of the filler is controlled between 85–45° C.; the plastisol uniformly added with steel balls or iron sand in the pipe bore then gradually gets denser, after cooling, the die core filled with the steel rope renders the artistic metallic straight pipe to form a solid straight pipe. In this way, the steel cord and the plastisol in the die core which are flexible make the pipe suitable for bending forging; the steel balls or iron sand in the pipe bore enable the die core to be resistant to forging pressure on the pipe wall so that the pipe wall can be prevented from over deforming; the die core can be slightly warmed up after bending forging to melt the plastisol, so that the die core bended in pursuance of the action of bending moment can be taken out of the pipe bore easily.
2. The die set used is made of spring steel and includes an upper and a lower die housing mating with each other, the die housings have on the two ends thereof supporting axles and formed therein two troughs which are provided respectively on the top and the bottom thereof with suitable amount of hard bracing stubs, both the lateral walls or die limiting sheet plates are provided with a plurality of "V" shaped gaps capable of absorbing bending deformation quantity, the external top and bottom surfaces respectively of the upper and lower die housings are provided thereon with two laminated springs; thus the solid straight pipe is placed between the two lateral walls or die limiting sheet plates of the troughs, the remaining space in the troughs are filled with liquid polyurethane (namely PU glue) to a saturated state, then the liquid polyurethane is heated to solidify under its solidifying temperature, it can thus envelop the solid straight pipe in the troughs and buries the hard bracing stubs, this therefore forms a specified die set used to forge the solid straight pipe to form a bended pipe. The "V" shaped gaps on the lateral walls of the die housings used for absorbing bending deformation quantity hold the solidified polyurethane to thereby maintain a stable deformation rate in forging to obtain the required bending curvature; the two laminated springs can distribute the forge action force uniformly to the whole die set, so that every part of the solid straight pipe in the die set bears equalized forge action force, and the die set can be bent to a desired curvature.
3. The hard bracing stubs of suitable amount on the upper and lower die housings and buried in the polyurethane are used for bracing the areas near the artistic metallic straight pipe where larger bracing force is required; so that the areas on the pipe wall where bending curvature is too large or dead corners are formed can get sufficient bearing force to resist bending moment.
4. By the nature of instant melting under a low temperature of the plastisol in the die core, the bended pipe forged can have its pipe wall released from the plastisol easily by slight warming and allows the die core to be taken out to reveal the non-damaged and perfect bended pipe.

The present invention will be further apparent in detail in respect to the above stated objects and characteristics by the detailed description of the manufacturing mode and the effect of the appartus used therewith in reference to the accompanying drawings.

DETAILED DESCRIPTION OF THE PREFERRED EMBODIMENT

Figure 1:
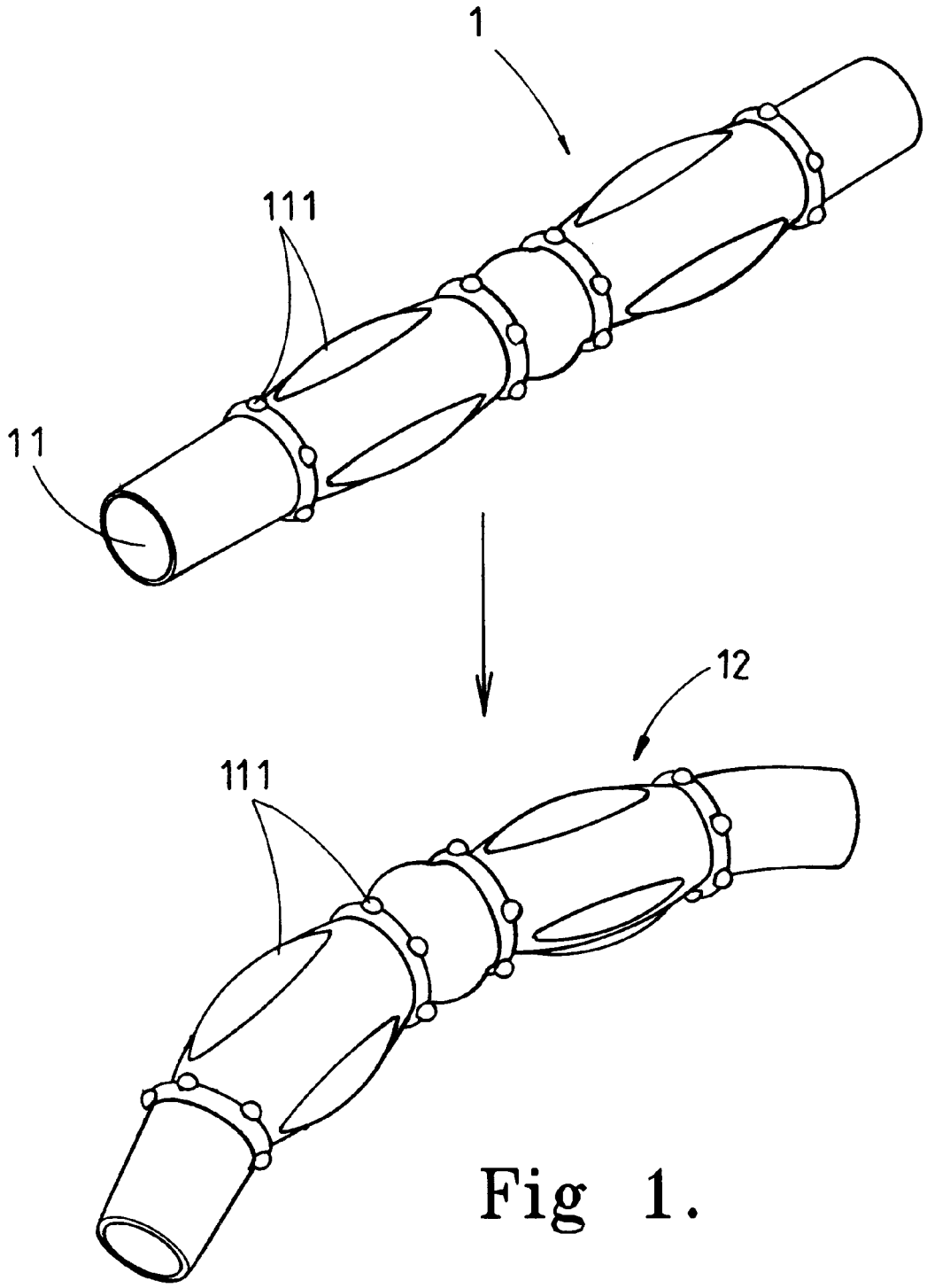
FIG. 1 is a schematic perspective view showing an artistic metallic straight pipe is made an artistic metallic bended pipe having a curvature.

As shown in FIG. 1, an artistic metallic straight pipe 1 having an embossed artistic outline 111 is used, in the present embodiment, a straight pipe 1 having more complicated embossment is disclosed for bending forging, a bended pipe 12 having required curvature is made by the method of the present invention.

Figure 2:
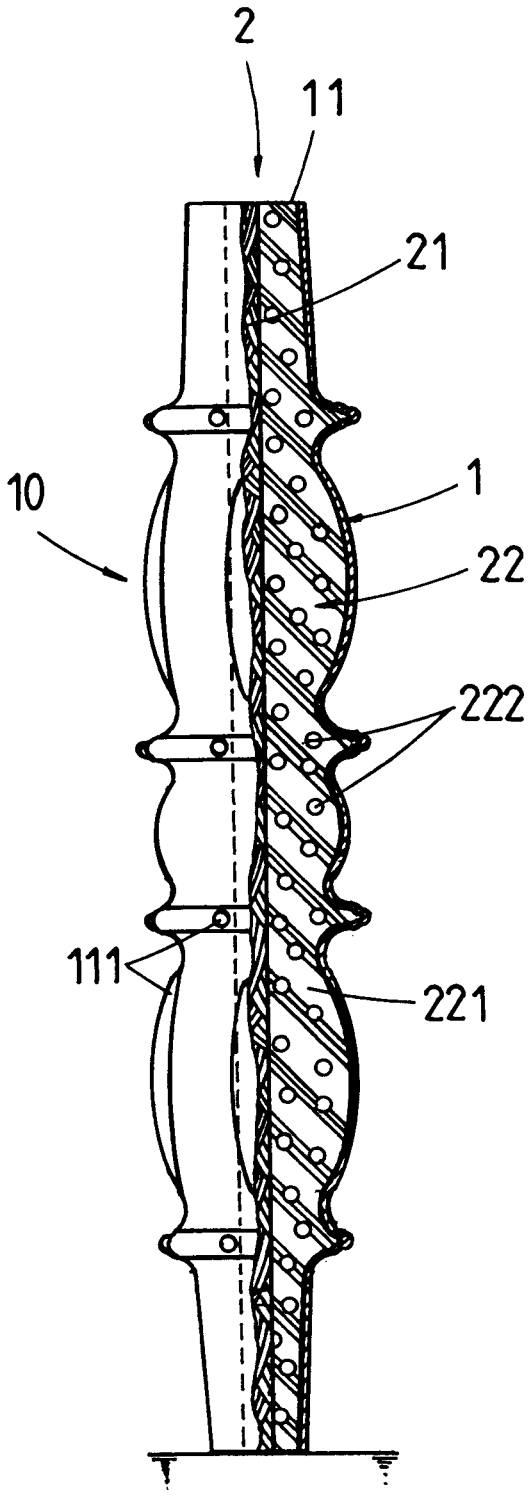
FIG. 2 is an anatomic view showing the pipe bore of the straight pipe of the present invention to be forged into a bended pipe is filled in antecedence with a die core to a full filled state.

Referring to FIG. 2, a die core 2 is in the first pla cd placed in the pipe bore 11 of the straight pipe 1, the die core 2 is made from a steel rope 21 and is extended in the pipe bore 11, a filler 22 for hot plastisol 221 being uniformly mixed is then introduced into the remaining space in the pipe bore 11; the way of introducing of the filler 22 into the pipe bore 11 is a well known screw feeding mode, temperature during introducing of the hot filler 22 is controlled between 85–45° C.; the filler 22 includes mainly molten plastisol 221, the plastisol 221 is poured into a conventional pounding mixer (a conventional plastisol mixer, not to be described herein), then steel balls 222 (or iron sand) in a suitable ratio are added therein for stirring the hot plastisol 221 under the melting temperature of 80–100° C., the molten plastisol 221 is sufficiently and uniformly mixed with the steel balls 222 (or iron sand) in a suitable ratio, thus the filler 22 is made; granularity and weight of the steel balls 222 (or iron sand) selected are very small, the suitable ratio is determined by the compression strength required by the die core 2; therefore, under the above mentioned temperature control for introducing the filler 22, the filler 22 loaded in the pipe bore 11 is uniformly distributed in a non-flowing state because of gradual getting denser thereof, when the plastisol 221 in the filler 22 is cooled to the ordinary temperature, it appears to be in a saturated state in the pipe bore 11 and envelops the steel rope 21 which is in a fixed state, thus a solid straight pipe 10 is formed.

Figure 3:
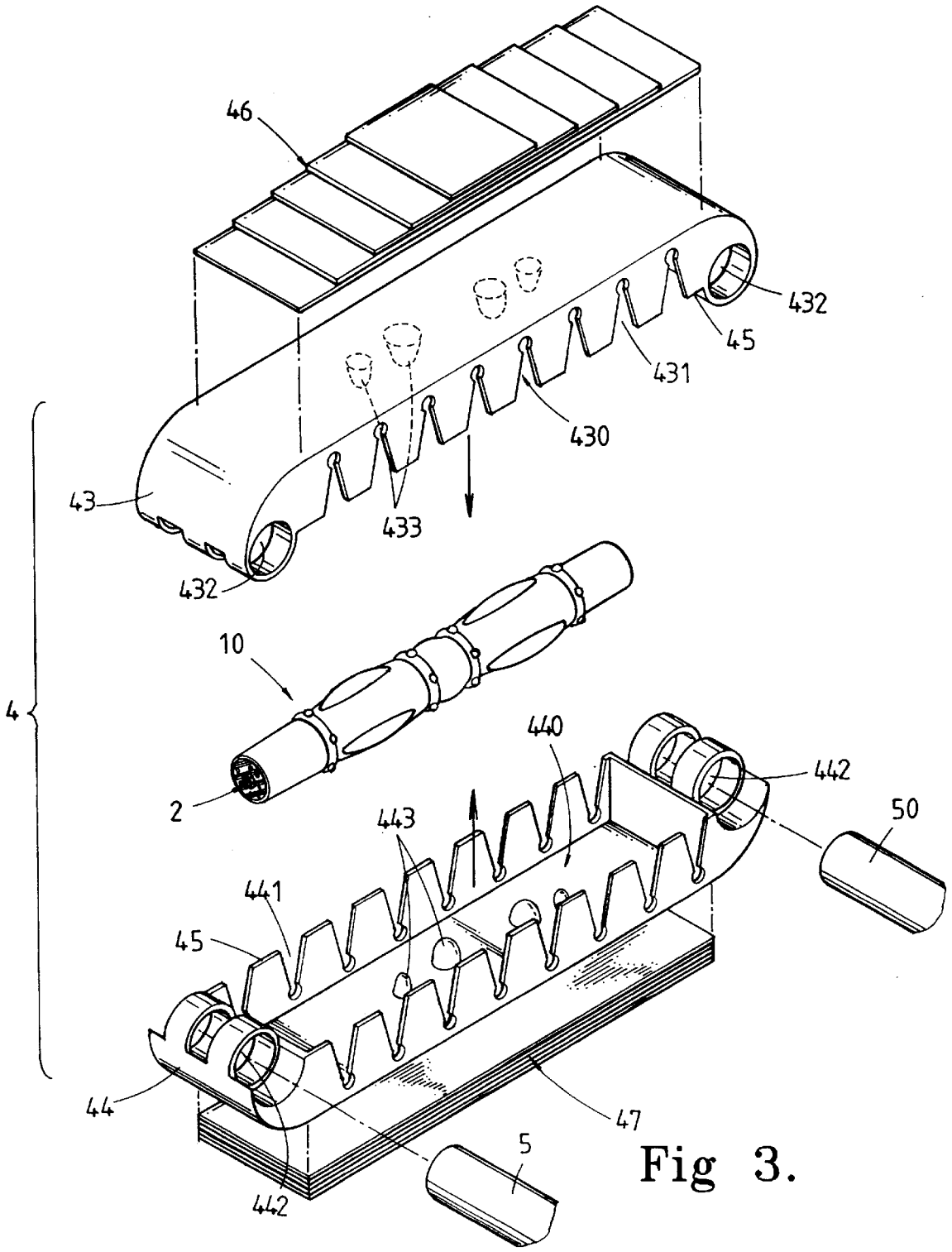
FIG. 3 is an analytic perspective view showing the basic structural of the flexible die set of the present invention.
Figure 4:
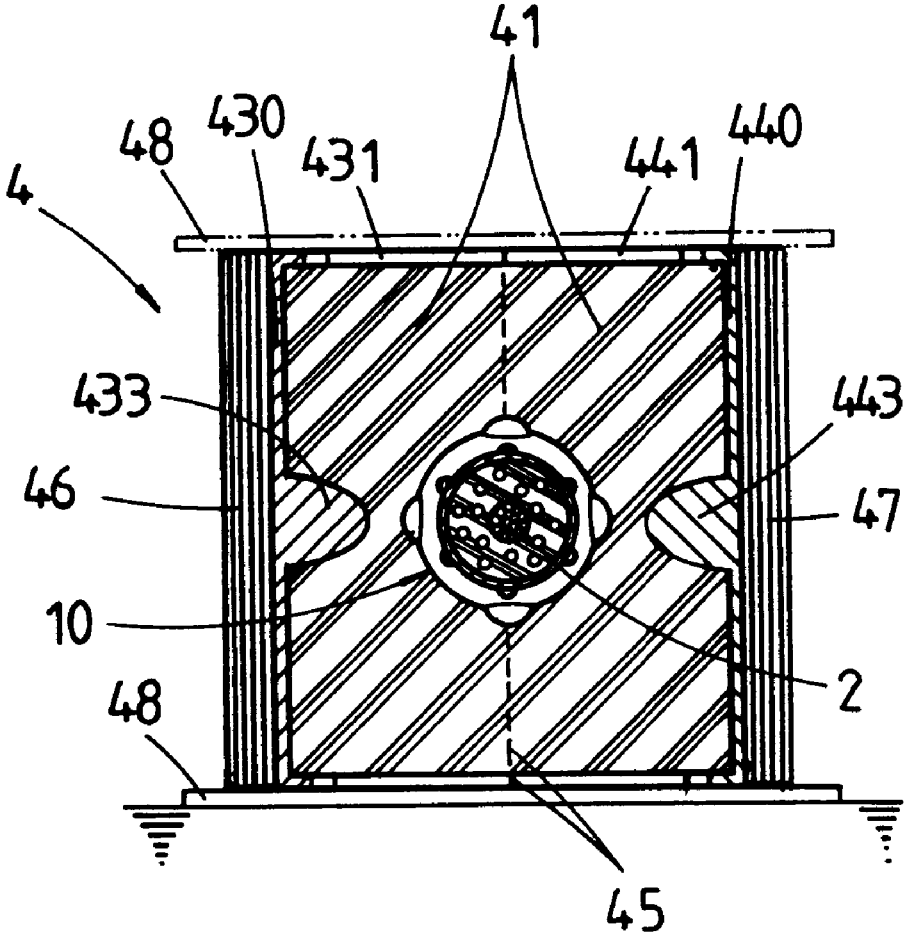
FIG. 4 is a sectional side view of the die set of the present invention filled with polyurethane.

Referring to FIG. 3, the solid straight pipe 10 is applied with a layer of release agent on the external wall thereof to prevent polyurethane from adhering thereto, and to make a smooth surface of the external wall; the solid straight pipe 10 is then placed in a die set 4 which is made of spring steel and includes an upper and a lower die housing 43, 44 mating with each other, the die housings 43, 44 are provided respectively with latch holes 432 and 442 alinged mutually, the die housings 43, 44 are formed respectively therein with troughs 430 and 440 which are provided by welding on the top and the bottom respectively thereof with hard bracing stubs 433, 443, both the lateral walls or die limiting sheet plates 45 are provided with a plurality of "V" shaped gaps 431, 441 capable of absorbing bending deformation quantity, the external top and bottom surfaces of the upper and lower die housings 43, 44 are provided thereon with two laminated springs 46, 47, thus a basic structure of the die set 4 is completed; the solid straight pipe 10 is placed between the two lateral walls or die limiting sheet plates 45 of the trough 430 as well as of the trough 440, the remaining spaces in the troughs 430 and 440 are filled with liquid polyurethane 41 (namely PU glue) to a saturated state (referring to FIG. 4), when in pouring of the liquid polyurethane 41, stop plates 48 can be added to cover the "V" shaped gaps 431, 441 of the die housings 43, 44 to prevent the liquid polyurethane 41 from flowing out, then the liquid polyurethane 41 is heated to solidify under its solidifying temperature, it can thus envelop the solid straight pipe 10 in the troughs 430 and 440 and buries the hard bracing stubs 433, 443, this therefore forms a specified die set 4 used to forge the solid straight pipe 10 to form a bended pipe.

Figure 5:
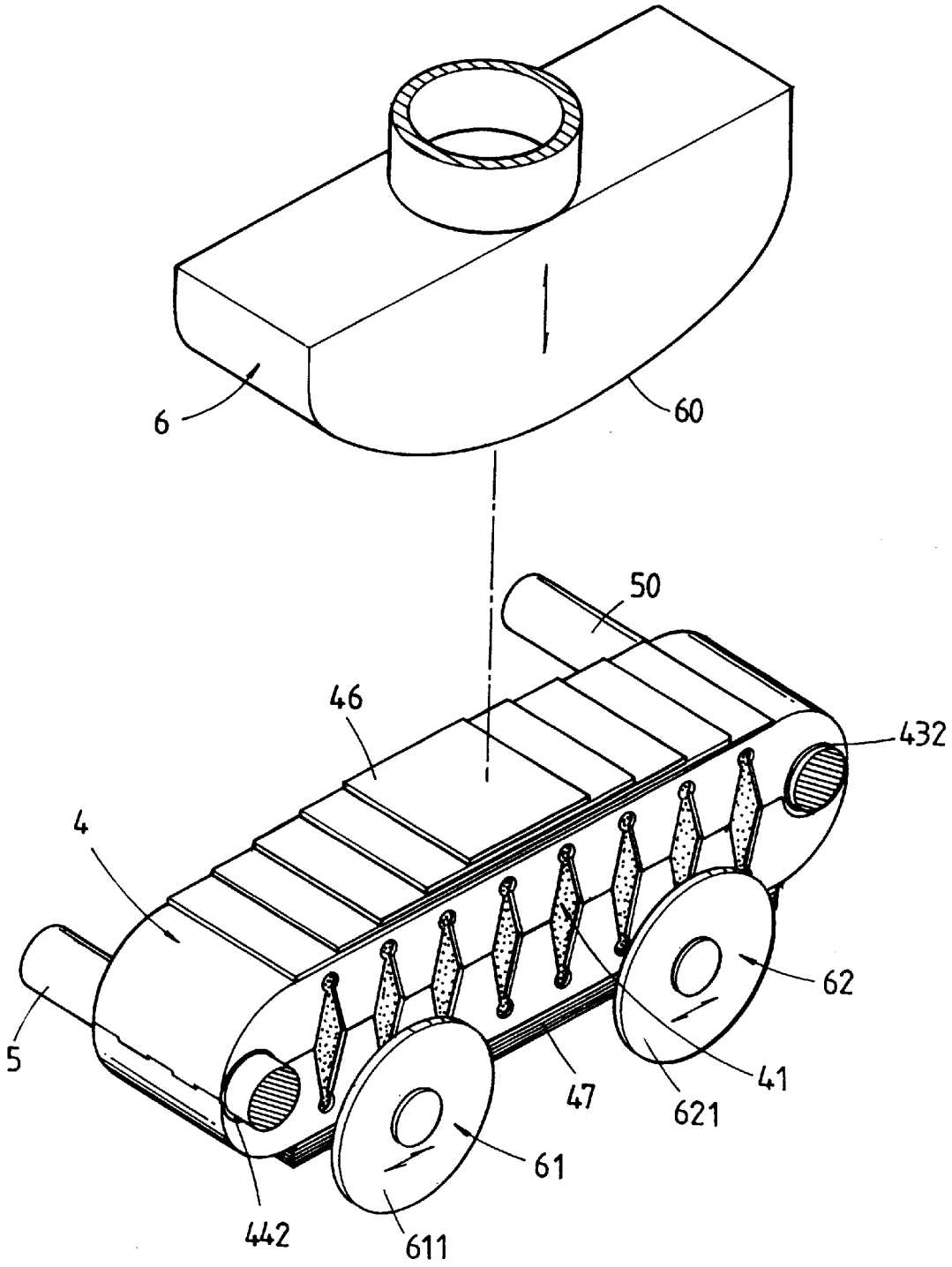
FIG. 5 is a perspective view showing closing of the die set of the present invention before forming a bended pipe with a forging press.
Figure 6:
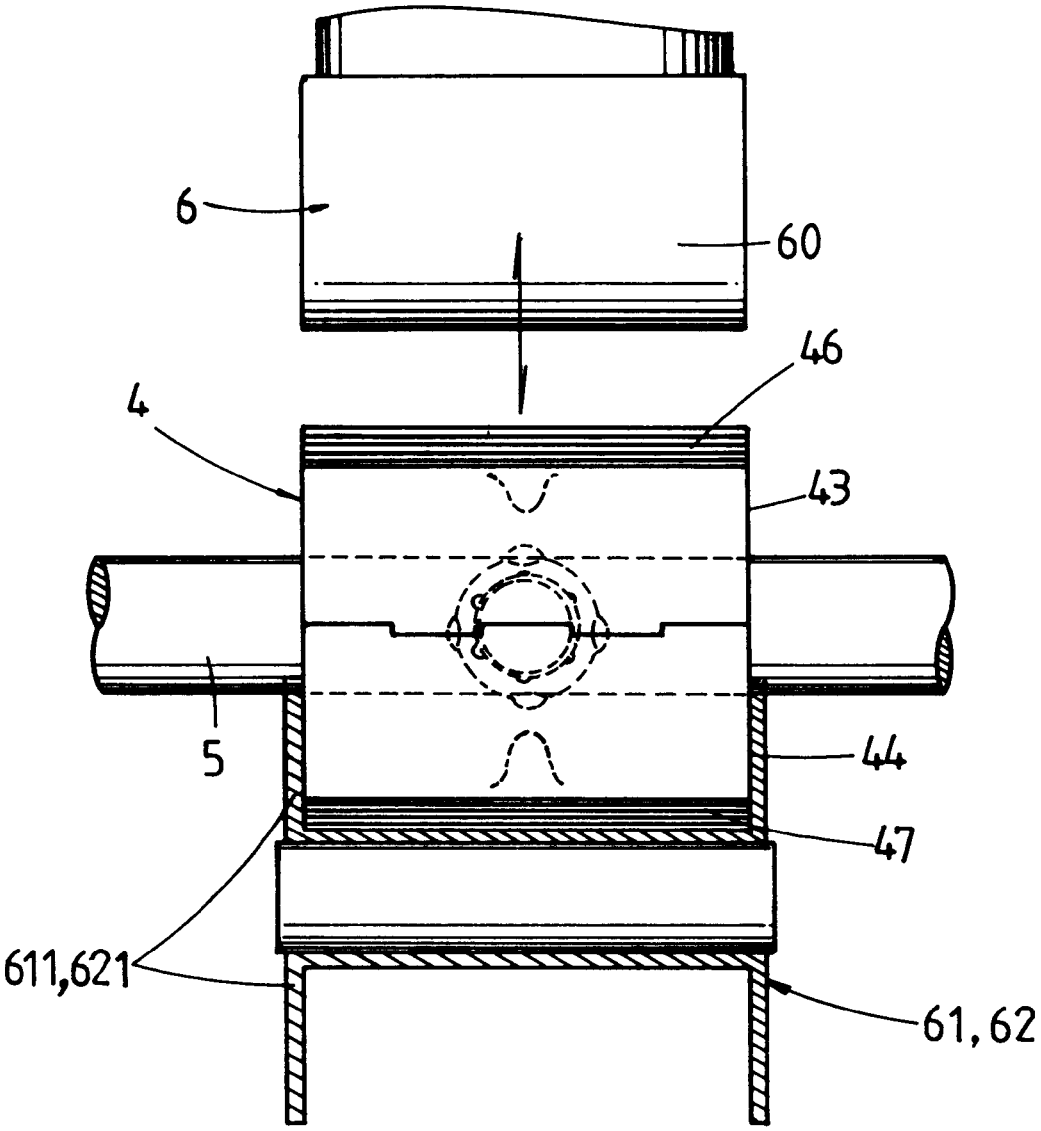
FIG. 6 is a sectional view showing installation of the die set and two H-wheels as shown in FIG. 5.
Figure 7:
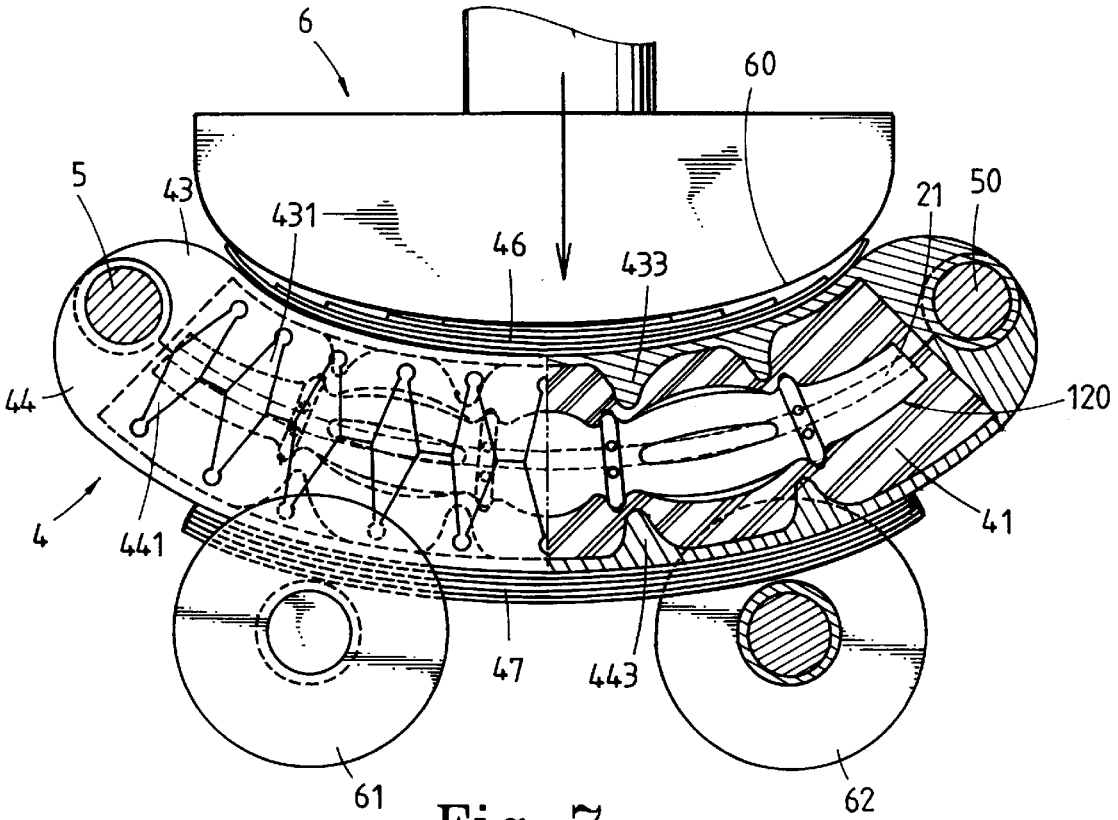
FIG. 7 is a sectional view showing the present invention is bending forged by the forging press, wherein, the pipe loaded in the die set is deformed.

As shown in FIG. 5, the die set 4 loaded with the solid straight pipe 10 is placed between a forging press 6 and two H-wheels 61, 62, the latch holes 432 and 442 on the two ends of the die set 4 are inserted therein with supporting axles 5, 50 respectively after alignment thereof mutually, the H-wheels 61, 62 are wheels which have lateral protection walls 611, 621 and can be moved horizontally for adjustment as well as freely rotated (as shown in FIG. 6), the die set 4 is provided on the bottom thereof with the laminated spring 47 which is placed on the bearing top surfaces of the wheel hubs, while the top of the die set 4 added with the laminated spring 46 bears down pressing action of the forging press 6; the contact surface 60 of the forging press 6 is formed to have a curvature which is exactly the curvature of the bended pipe to be formed; as shown in FIG. 7, when the forging press 6 moves down to press the die set 4, the die set 4 is supported or limited by the supporting axles 5, 50 and the two H-wheels 61, 62, both sides of the upper and the lower die housings 43, 44 of the die set 4 are used to absorb bending deformation quantity via the "V" shaped gaps 431, 441 and to hold the solidified polyurethane to thereby maintain a stable deformation rate in forging to form the required bending curvature; the two laminated springs 46, 47 can distribute the forge action force uniformly to the whole die set 4, so that every part of the solid straight pipe 10 in the die set 4 bears equalized forge action force, and the die set 4 can be bent to a desired curvature; the metallic pipe shown in FIG. 7 has been forged into a solid bended pipe 120 with the desired curvature, the forging press 6 can now be retracted to release forging pressure, then the upper and lower die housings 43, 44 are separated to take out the solidified polyurethane 41 and take out the forged solid and bended pipe 120 too, the pipe bore is heated to the melting point of the plastisol 221 to slightly melt the plastisol 221 in the bended die core 20 for separating same from the wall in the pipe bore, then the steel rope 21 is drawn to loosen the whole die core 20 for taking it out, thus the process for forging the artistic metallic straight pipe 1 into the bended metallic pipe is completed.

Conclusively, the manufacturing process of the bended metallic pipe and the die set used therein is suitable for all metallic pipes needed to be forged into bended shape, such metallic pipes include solid as well as hollow pipes, and especially those artistic metallic pipes having complicated outlines. By using the method of the present invention stated above, the bending forging can be proceeded easily under the condition of maintaining the original artistic outlines on the inner as well as exterior walls of the pipes to be forged, the trouble of difficulty in processing such pipes resided in the conventional techniques thus is overcome,

Having thus described my invention, what I claim as new and desire to be secured by Letters Patent of the United States are:

1. A method for bend forging an artistic metallic straight pipe including:

providing the metallic straight pipe to be bending forged with a bendable die core including a steel rope and filler comprising a plastisol and a suitable amount of steel balls or iron sand under the temperature of 80–100° C. and introduced into a pipe bore of said metallic straight pipe in a screw feeding mode under the temperature of 85–45° C. to uniformly distribute said steel balls or iron sand in said plastisol and to envelop said steel rope;

forming a solid straight pipe then by cooling of said plastisol to room temperature;

placing said solid straight pipe in troughs in an upper and a lower die housing of a die set, and pouring liquid polyurethane into said troughs;

heating said liquid polyurethane for solidifying under its solidifying temperature thereby enveloping said solid straight pipe in said troughs;

placing said die set under a forging press to make said die set be supported on its two ends by two supporting axles, while the bottom of said die set is placed on two H-wheels which are horizontally movable for adjustment as well as freely rotated;

bending said die set under forging pressure of said forging press and resistive support of said two supporting axles and said two H-wheels, this in turn applies a bending moment on said solid straight pipe in said die housings to forge same;

retracting said forging press after said solid straight pipe is forged to have the desired bending curvature, said die housings being separated to take out said polyurethane and a forged solid and bent pipe, said pipe bore being heated to the melting point of said plastisol to slightly melt said plastisol in said bent die core for separating same from the wall in said pipe bore, then said steel rope being drawn to loosen the die core for removal.

2. The method for bend forging an artistic metallic straight pipe as defined in claim 1, wherein:

a ratio for mixing a suitable amount of said steel balls or iron sand added into said plastisol is based on a strength requirement and a thickness of the wall of said metallic pipe.

* * * * *